US010992046B2

(12) United States Patent
Howarth et al.

(10) Patent No.: US 10,992,046 B2
(45) Date of Patent: Apr. 27, 2021

(54) LOW PROFILE HIGH GAIN DUAL POLARIZATION UHF/VHF ANTENNA

(71) Applicant: BAE SYSTEMS Information and Electronic Systems Integration Inc., Nashua, NH (US)

(72) Inventors: Dean W. Howarth, Sudbury, MA (US); Timothy J. McLinden, Nashua, NH (US); Court E. Rossman, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 202 days.

(21) Appl. No.: 16/438,889

(22) Filed: Jun. 12, 2019

(65) Prior Publication Data

US 2020/0395655 A1 Dec. 17, 2020

(51) Int. Cl.

| | |
|---|---|
| ***H01Q 9/28*** | (2006.01) |
| ***H01Q 9/27*** | (2006.01) |
| *H01Q 1/28* | (2006.01) |

(52) U.S. Cl.

CPC ..... *H01Q 9/28* (2013.01); *H01Q 9/27* (2013.01); *H01Q 1/28* (2013.01)

(58) Field of Classification Search

CPC ..... H01Q 9/27; H01Q 9/28; H01Q 1/28

See application file for complete search history.

(56) References Cited

U.S. PATENT DOCUMENTS

| | | | | |
|---|---|---|---|---|
| 3,624,658 | A | 11/1971 | Voronoff | |
| 3,820,117 | A * | 6/1974 | Hall | H01Q 9/27 343/802 |
| 3,828,351 | A | 8/1974 | Voronoff | |
| 5,257,032 | A * | 10/1993 | Diamond | H01Q 1/36 343/727 |
| 5,621,422 | A * | 4/1997 | Wang | H01Q 1/36 343/700 MS |
| 5,815,122 | A * | 9/1998 | Nurnberger | H01Q 9/27 343/767 |
| 6,853,351 | B1 | 2/2005 | Mohuchy | |
| 7,460,083 | B2 | 12/2008 | Parsche et al. | |
| 8,847,846 | B1 | 9/2014 | Diaz | |

* cited by examiner

*Primary Examiner* — Daniel Munoz

(74) *Attorney, Agent, or Firm* — KPIP Law, PLLC

(57) ABSTRACT

The system and method for a low profile high gain dual polarization UHF/VHF antenna. In some cases a spiral antenna over a small cavity, with arms attached on either side is provided. The antenna structure is a short distance above a ground plane (e.g., less than 1/10 wavelength at the high frequency of operation). The arms are terminated to ground and the values of the terminations can vary depending on installation and the value chosen for the spiral termination. In some cases, the spiral antenna is not limited to a two arm spiral only as any type of spiral antenna may be used.

8 Claims, 11 Drawing Sheets

LOW PROFILE HIGH GAIN DUAL POLARIZATION UHF/VHF ANTENNA

FIELD OF THE DISCLOSURE

The present disclosure relates to radio frequency antennas and more particularly to low profile high gain dual polarization UHF/VHF antennas.

BACKGROUND OF THE DISCLOSURE

Traditional antennas that operate in the UHF/VHF frequency range, are large and are a large distance above a ground plane when the antenna has a directional antenna pattern. Additionally, conventional UHF/VHF antennas typically do not provide dual polarized positive gain in a direction boresite to the antenna, when the antenna is in close proximity to ground plane while at the same time providing a better than 4:1 VSWR over a 4+:1 bandwidth.

Wherefore it is an object of the present disclosure to overcome the above-mentioned shortcomings and drawbacks associated with conventional radio frequency antennas by addressing the shortcomings in the state of the art related to a low physical profile antenna, a small distance above the ground plane, and providing a positive gain boresite to the antenna.

SUMMARY OF THE DISCLOSURE

One aspect of the present disclosure is a UHF/VHF antenna, comprising: a spiral antenna; a pair of horizontal arms attached on either side of the spiral antenna; and a small cavity located beneath the spiral antenna, wherein the antenna is a distance above a ground plane.

One embodiment of the UHF/VHF antenna is wherein the spiral antenna has a spiral with two or more arms. In some cases each of the pair of arms have resistors placed in series along the arms.

Another embodiment of the UHF/VHF antenna is wherein each of the pair of arms are terminated with resistors to ground.

In some cases the distance above the ground plane is about two inches or less than 1/10 wavelength at a high frequency of operation.

Yet another embodiment of the UHF/VHF antenna is wherein the antenna is a dual polarization antenna. In certain embodiments, the antenna has a 3:1 VSWR over a frequency bandwidth and 0 dBi gain at boresite for most of the band in both polarizations.

Still yet another embodiment of the UHF/VHF antenna is wherein the antenna is mounted to the side of the aircraft with a radar warning receiver system attached to it within the aircraft.

In some cases, the antenna is mounted to the side of the aircraft with a communications radio attached to it. In certain embodiments, the antenna is mounted to the side of the aircraft with a RF transmitter attached to it.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

One embodiment of a low profile high gain dual polarization UHF/VHF antenna of the present disclosure is used for metal skin aircraft and airplanes that require a low profile high gain antenna. The antenna of the present disclosure has applications in the commercial communications space as well as for airplanes, drones and other small factor applications. In some cases, the form factor, the input power level, and the required gain over a required frequency range drives the overall design and dimensions of the antenna.

Figure 1A:
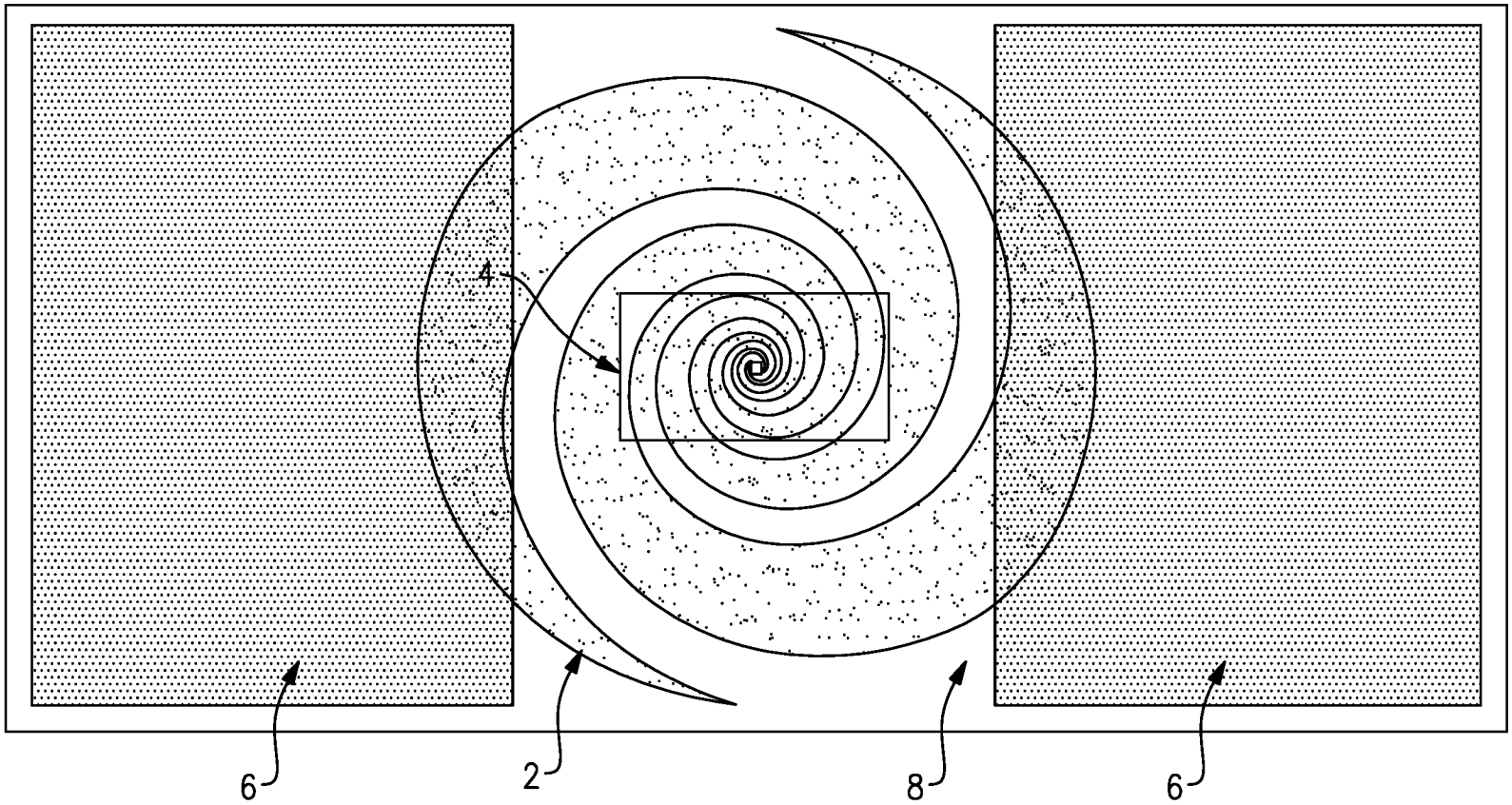
FIG. 1A shows one embodiment of a low profile high gain dual polarization UHF/VHF antenna of the present disclosure.

Referring to FIG. 1A, one embodiment of a low profile high gain dual polarization UHF/VHF antenna 5 of the present disclosure is shown. More specifically, the core elements of the UHF/VHF antenna 5 are a spiral antenna 2 having arms 6 with a small cavity 4 (better seen in FIG. 2A and FIG. 2B) located behind the spiral antenna 2 to allow feed cables to attach to the feed of the antenna. FIG. 1A shows view from a computer model that has a 100 ohm differential feed across the gap of the two spiral arms. The physical embodiment of this would have two RF cables and a 180 degree hybrid to excite the spiral properly. The spiral antenna 2 in this example has outwardly extending spiral sections that are then attached to non-spiral arms 6 which in this example are rectangular arms and planar with the spiral sections. In this embodiment, the spiral antenna 2 and the two horizontal dipole arms 6 sits a small distance above a ground plane (best seen in FIG. 1B, FIG. 2A, and FIG. 2B). In FIG. 1A the spiral antenna 2 is disposed on a mounting substrate 8, such as a dielectric substrate. The substrate 8 has sections without the spiral antenna 2 that would be considered safe areas to cut without impacting antenna performance. The whole antenna is held off the metal ground plane either by non-conducting standoff or as in this embodiment a dielectric permittivity foam like Rohacell with a value close to 1. In one embodiment, the ends of the arms 6 are terminated with resistors to ground such as shown in FIG. 2B.

In one embodiment of the present disclosure, the spiral antenna 2 resides over a small cavity 4, with arms 6 attached to the spiral sections. In this example, there are two spiral sections with two corresponding rectangular sections attached to the two spiral sections. The whole antenna structure is a short distance above a ground plane (e.g., less than 1/10 wavelength at the high frequency of operation). The ground plane in one example is a metal fuselage of an aircraft. The arms in this example are terminated to ground, such as to the ground plane. The values of the terminations can vary depending on installation and the value chosen for the spiral termination. In some cases, the spiral antenna is not limited to two arm spirals - any type of spiral antenna can be deployed which is then coupled to the larger non-spiral arms. This example shows that the spiral antenna has a single differential feed and the spiral sections and arms are attached.

Figure 1B:
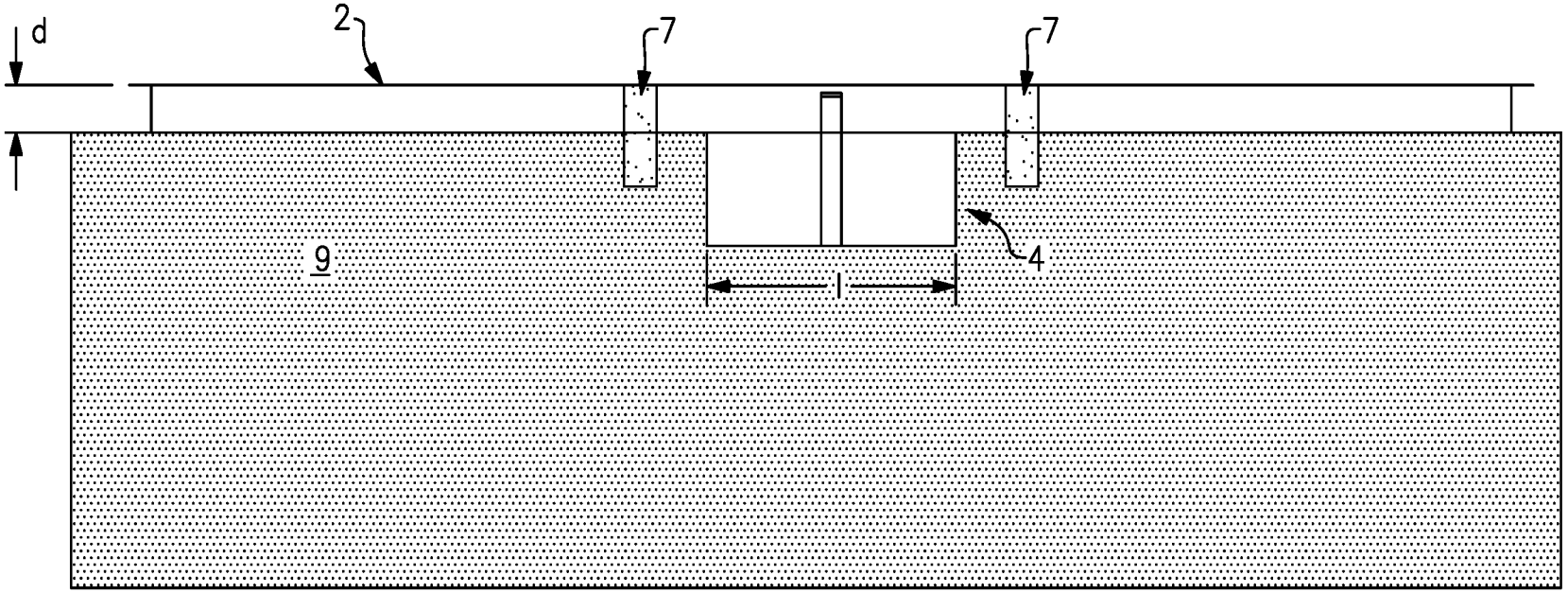
FIG. 1B shows a side view perspective of the low profile high gain dual polarization UHF/VHF antenna of FIG. 1A.
Figures 2A, 2B:
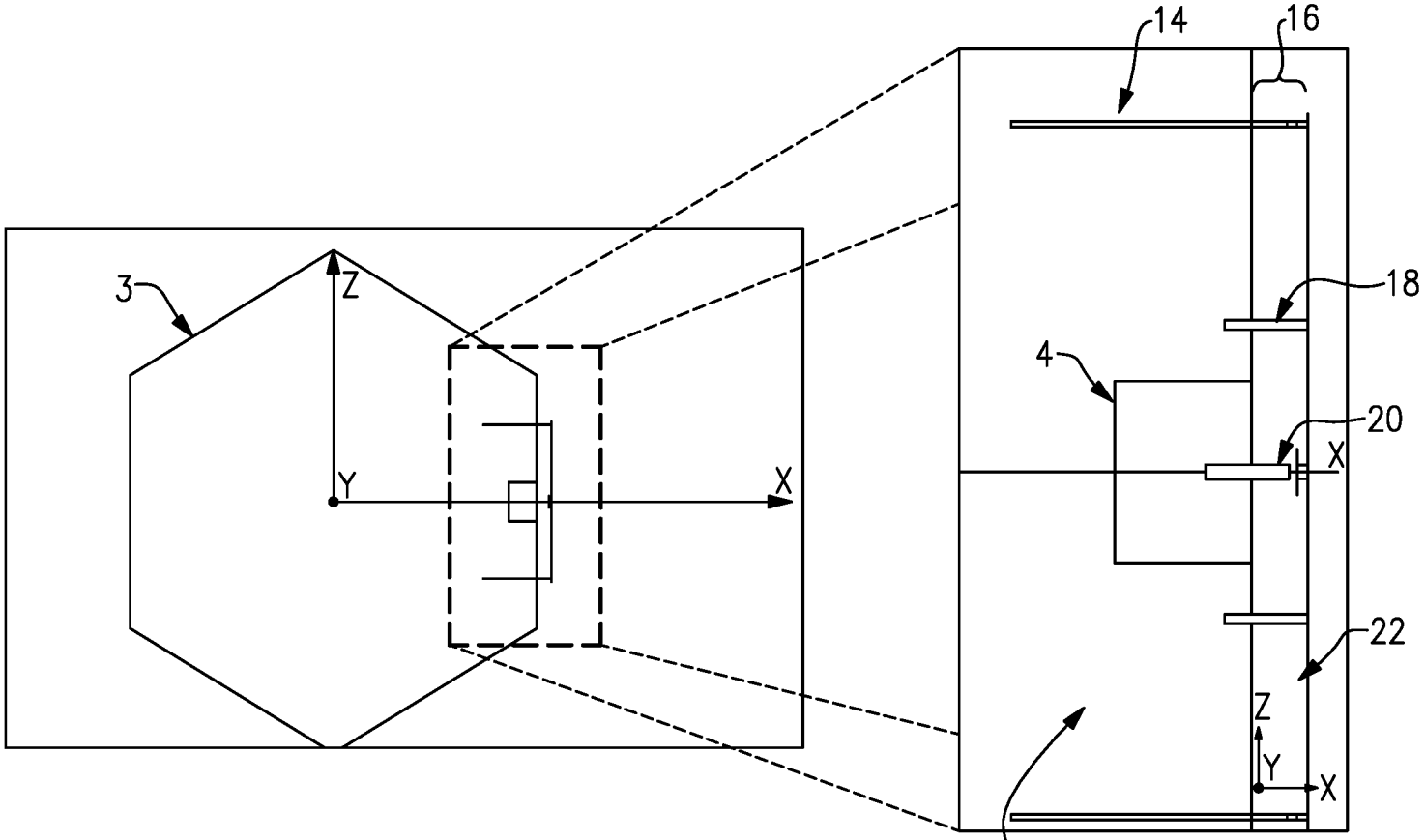
FIG. 2A shows a side view of the embodiment of a low profile high gain dual polarization UHF/VHF antenna of the present disclosure installed on a hexagonal ground plane as shown in FIG. 1C.
FIG. 2B shows an enlarged view of a portion of the side view of the embodiment of a low profile high gain dual polarization UHF/VHF antenna of the present disclosure installed on a hexagonal ground plane as shown in FIG. 2A.

Referring to FIG. 1B, in this side view perspective, the spiral antenna 2 having extended arms 6 is shown mounted on the substrate and positioned a distance d above the ground plane 9. In one example the distance d is about 2 inches. There are resistive termination elements 7 that are coupled from the spiral antenna 2 to the ground plane 9. In one example the resistors are about 200 ohms and are coupled at the end of the spiral sections to the ground plane 9. The cavity 4 is shown having a length 1 that in one example is about 11 inches.

Initially, the requirements for the antenna consisted mainly of a requirement that the cavity fit within the ribs and risers of an aircraft and not protrude into the engine compartment more that about 5 inches. This specific requirement led to a cavity dimension of 6 inches×11 inches×less than 5 inches. FIG. 1A, FIG. 1C and FIG. 2A and FIG. 2B show different views and configuration for this embodiment of the antenna. In one embodiment the antenna 5 is about 5 feet long and about 2 feet tall and mounts to an aircraft fuselage between the aircraft ribs.

Figure 1C:
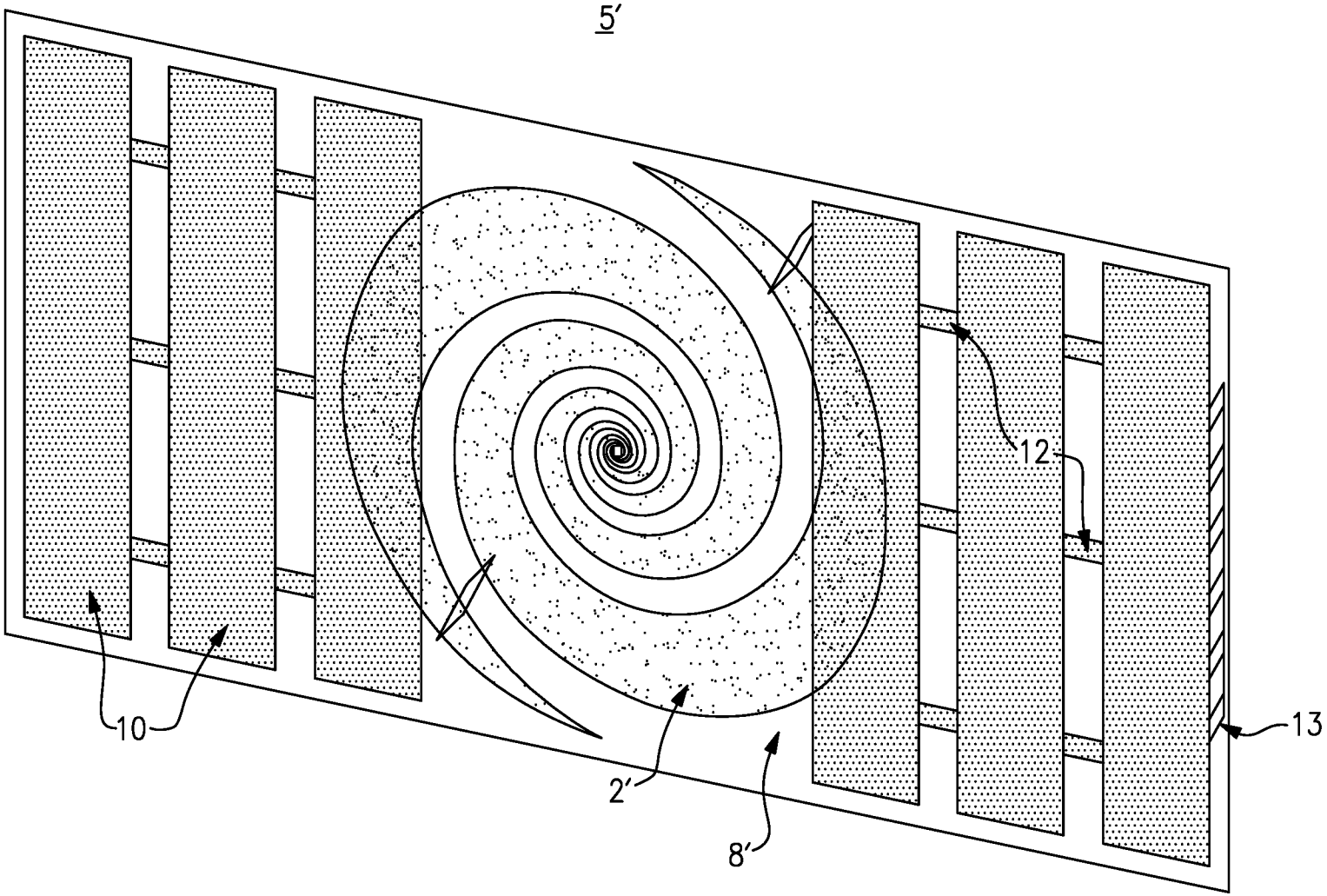
FIG. 1C shows another embodiment of a low profile high gain dual polarization UHF/VHF antenna of the present disclosure.

Referring to FIG. 1C another embodiment of a low profile high gain dual polarization UHF/VHF antenna 5' of the present disclosure is shown which shows that the arms are a plurality of arm sections 10. In addition, resistors 12 are placed in series along the arm sections 10 electrically coupling the arm sections. In this example, the distributed resistance 12 along the arm sections 10 has a smooth VSWR response and broad antenna patterns. In this embodiment, a spiral antenna 2' was also used having spiral sections coupled to rectangular arm sections 10. In FIG. 1B the spiral antenna 2' with the multiple arms is mounted to the substrate 8'. In one example there are vias 13 in the substrate 8 providing electrical connectivity to the spiral antenna and arms.

The values, spacing and number of resistors was parameterized. The gain for this option so far had some dips below −5 dBi that were deemed unacceptable. The periodic nature of the vertical cuts in the arms, the spacing between arms 10 and the resistor spacing potentially led to narrow frequency band drops in gain. Depending on the particular application, the dimensions of the arms is optimized. In some cases, both length and width are modified. The size of the cavity can also be varied in size and shape.

Figure 1D:
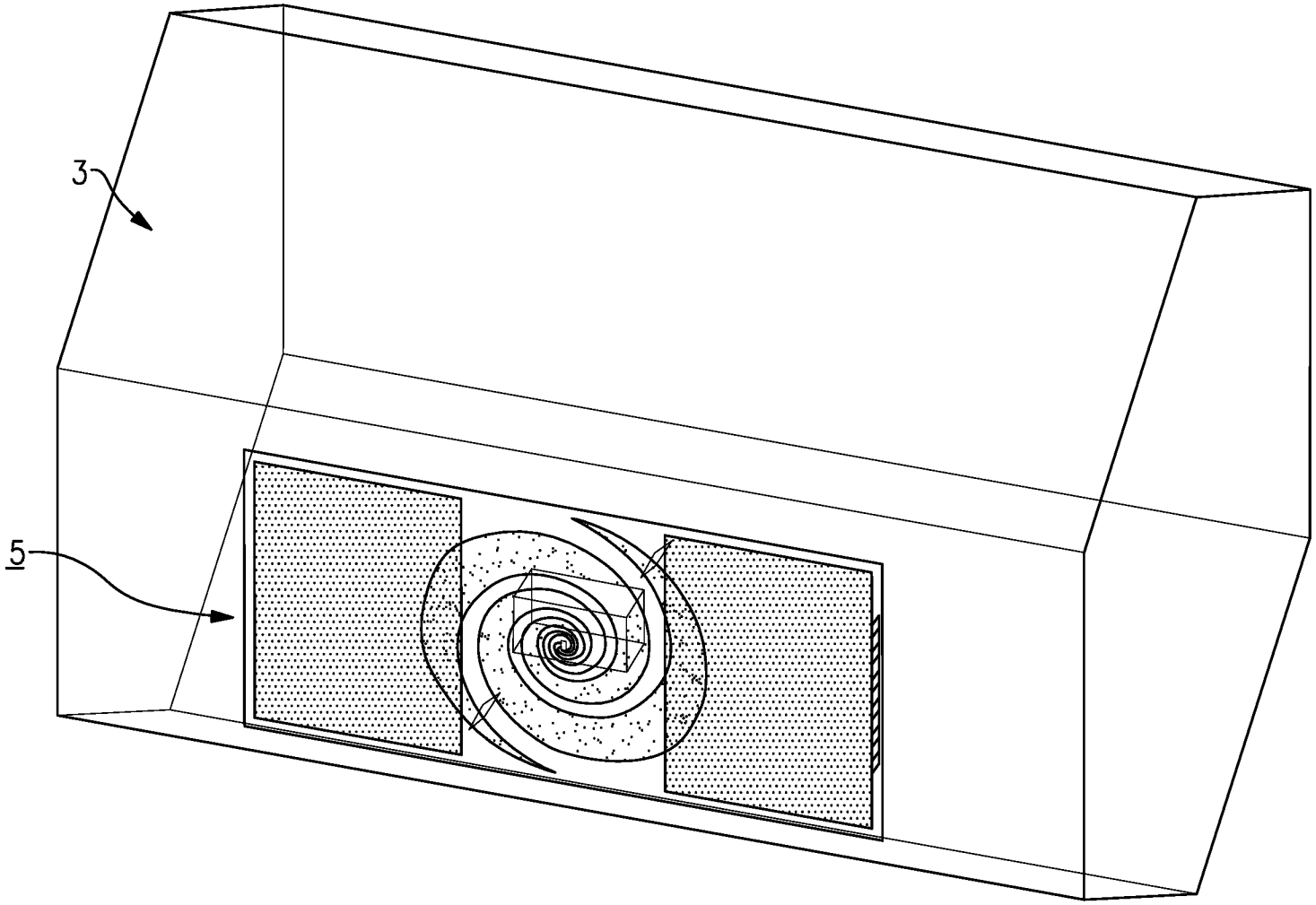
FIG. 1D shows a frontal view of one embodiment of a low profile high gain dual polarization UHF/VHF antenna of the present disclosure installed on a hexagonal ground plane.

Referring to FIG. 1D, a frontal view of one embodiment of the low profile high gain dual polarization UHF/VHF antenna of the present disclosure installed on a hexagonal ground plane is shown. More specifically, in this embodiment, the spiral antenna with resistively terminated arms is shown. In certain embodiments, the antenna is a log spiral with horizontal dipole arms to increase low band H-pol gain. FIG. 1D shows the antenna on a surrogate fuselage or ground plane 3. In this test case, the antenna was not modeled on an infinite ground plane so the results would be closer to the final results when modeled on the actual fuselage.

Referring to FIG. 2A, a side view of the embodiment of a low profile high gain dual polarization UHF/VHF antenna of the present disclosure installed on a hexagonal ground plane structure 3 as shown in FIG. 1C is shown. Referring to FIG. 2B, an enlarged view of a portion of the side view of the embodiment of a low profile high gain dual polarization UHF/VHF antenna of the present disclosure installed on a hexagonal ground plane structure 3 as shown in FIG. 2A is shown.

More specifically, in some cases, the antenna has an elevation/protrusion above the ground plane (e.g., on the fuselage). In one example the elevation is about 2 inches. In some cases, the antenna has a small cavity 4 to route the RF feed with the electronics to the central feed 20 of the antenna. In this model the central feed 20 of the antenna is modeled as a single metal tube with the diameter of 2 RF cables. The 2 feeds are modeled at the end of the tube going to each arm of the spiral. In some embodiments, the cavity 4 can be about 11 inches×about 6 inches×about 5 inches inside the fuselage. A balanced 180 degree feed (e.g., two coaxes feed the spiral from a 180 degree splitter) is used when this antenna is physically constructed. In some cases, the antenna is a distance 16 above the ground plane. The various ground connectors 14, resistive terminations 18 and/or central feed 20 can serve as standoffs to maintain the proper distance 16. In certain embodiments, the distance is about 2 inches. In one example, at the ends of the arms and spiral antenna are resistors to ground. In this embodiment, the ground connectors 14 provide the terminations at the end of the arms and there are resistive terminations 18 at the end of the spiral sections to ground. The termination resistance value can vary depending on the values on the ends of the arms and are used for impedance matching. They can be axial resistors or surface mount resistors. They can also be built out of resistive card material. The feed cable 20 and antenna element 22 are seen from a side view. The antenna element can be made out of any electrically conductive material. In certain embodiments, the goal was to maintain a 3:1 VSWR over the bandwidth because the system requirements.

In certain embodiments, the resistor values on the ends of the spiral and horizontal arms are optimized for impedance matching. The goals of the optimization can be a 3:1 VSWR across the whole or 4:1 VSWR across the whole. One optimization method was to try different weighing functions and design rules to narrow down on a 3:1 VSWR (FIG. 3A)

and 4:1 VSWR (FIG. 3B) solution. As seen in FIGS. 3A and 3B, the gain of the 3:1 VSWR antenna had better overall gain as compared to the 4:1 optimized VSWR.

Figure 3A:
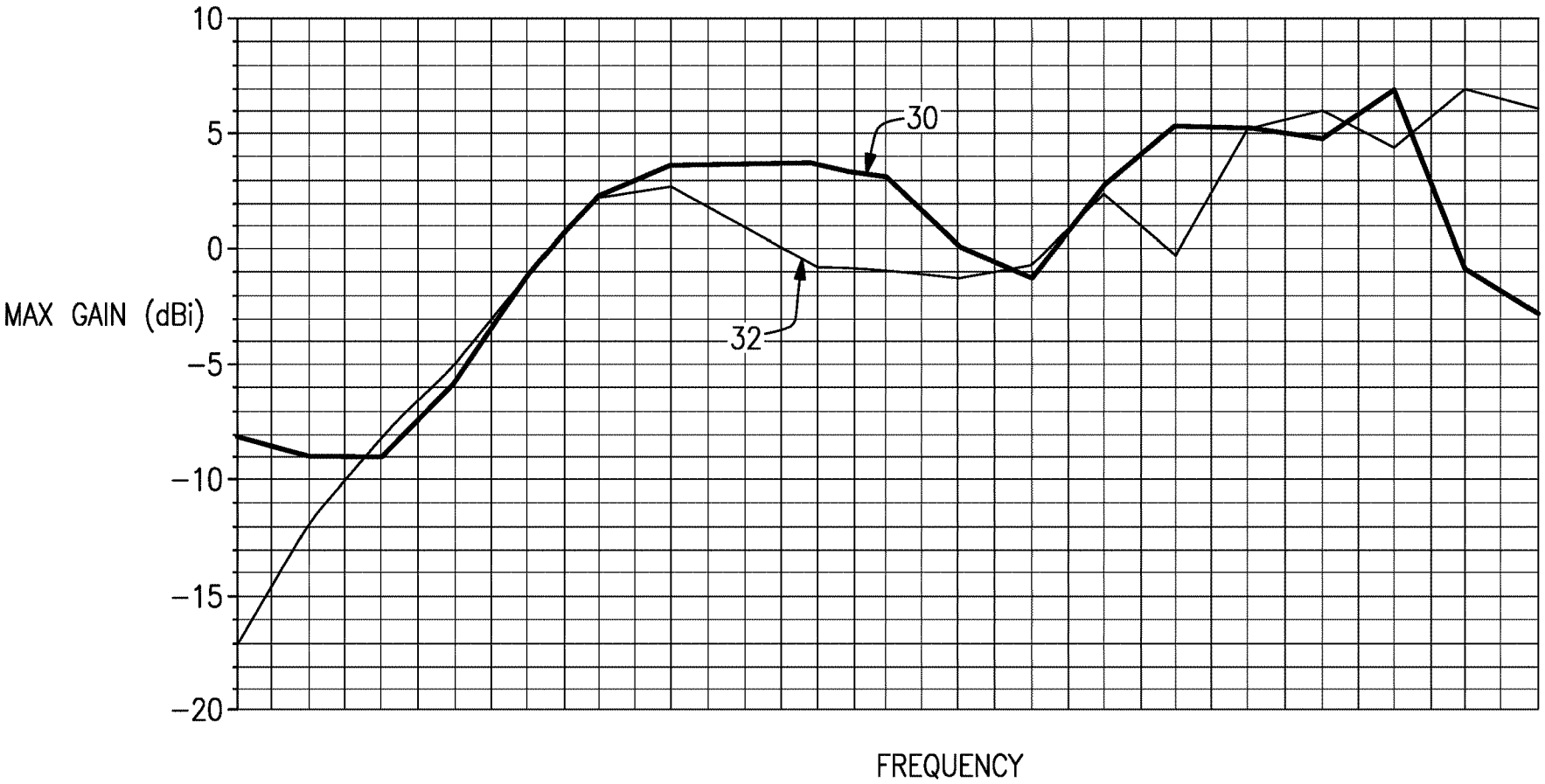
FIG. 3A shows one embodiment of a low profile high gain dual polarization UHF/VHF antenna of the present disclosure having a 3:1 Voltage Standing Wave Ratio (VSWR).
Figure 3B:
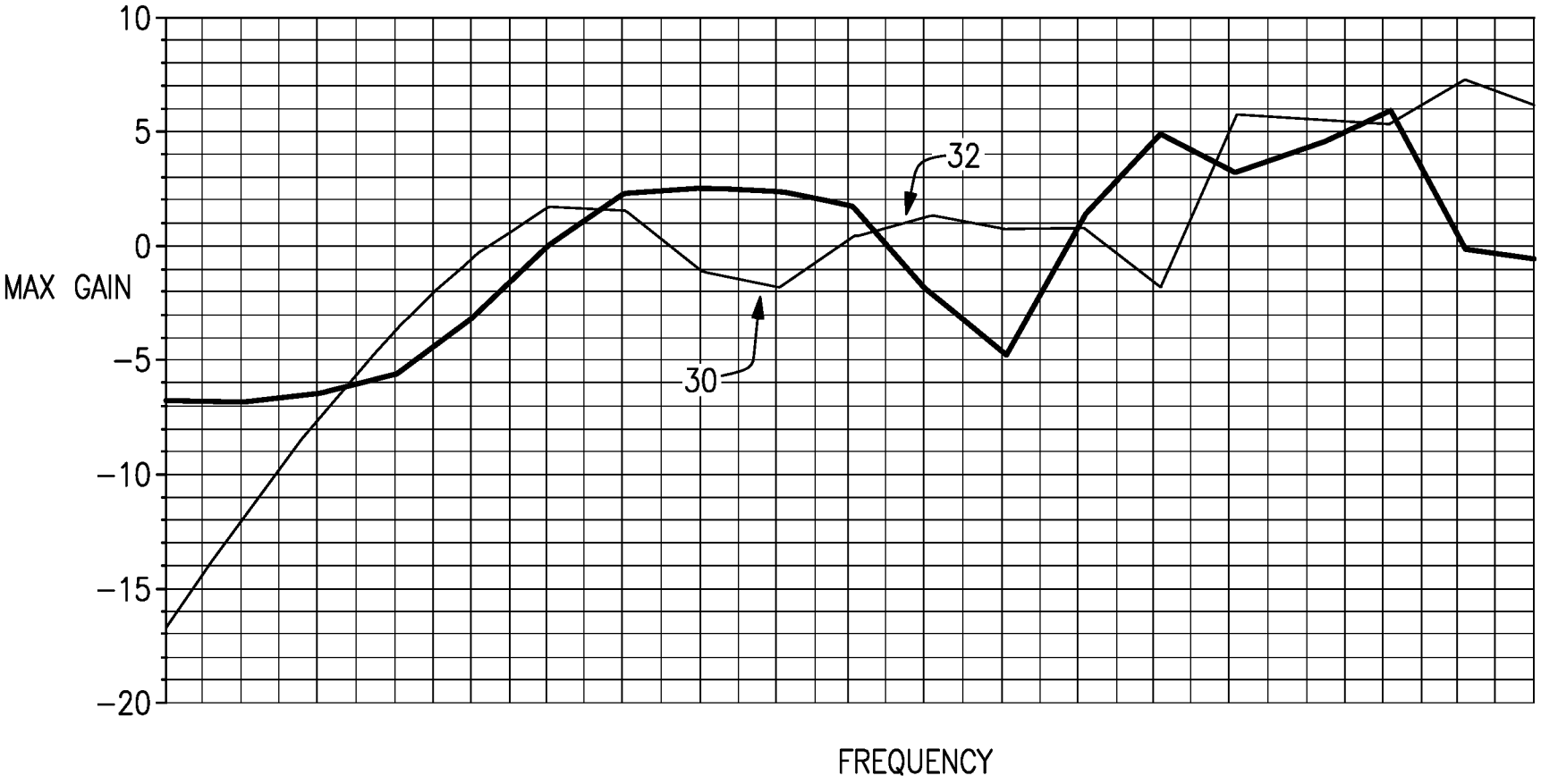
FIG. 3B shows one embodiment of a low profile high gain dual polarization UHF/VHF antenna of the present disclosure having a 4:1 Voltage Standing Wave Ratio (VSWR).

Referring to FIG. 3A, one embodiment of a low profile high gain dual polarization UHF/VHF antenna of the present disclosure having a 3:1 Voltage Standing Wave Ratio (VSWR) is shown. There, H-pol 30, realized gain Phi, has a phi=0 and theta=90 and V-pol 32, realized gain theta, has a phi=0 and theta=90. These curves represent the gain boresite to the antenna in each polarization. Referring to FIG. 3B, one embodiment of a low profile high gain dual polarization UHF/VHF antenna of the present disclosure having a 4:1 Voltage Standing Wave Ratio (VSWR) is shown. There, H-pol 30, realized gain Phi, has a phi=0 and theta=90 and V-pol 32, realized gain theta, has a phi=0 and theta=90. These curves represent the gain boresite to the antenna in each polarization.

Still referring to FIG. 3A and FIG. 3B, a dip to −5 dBi at 320 MHz was deemed an unacceptable result. The plots are for a point in physical space. Antenna patterns were reviewed to make sure that they had at least 10 degrees of beamwidth in both azimuth and elevation for each polarization (See, e.g., FIG. 4A-FIG. 5B). In some cases, the platform is not a square box, but rather has some curvature in the front to back and the top to bottom directions. In one embodiment, the planned installation location has a 3 degree sweep in azimuth. Therefore, in one embodiment the peak of the gain would move from 0 degrees to −3 degrees. In some cases, if the antenna has flat antenna gain over a +/−5 degree window then the antenna may not need to be re-optimized once installed on the platform.

In telecommunications and radar engineering, antenna boresight is the axis of maximum gain (maximum radiated power) of a directional antenna. For most antennas the boresight is the axis of symmetry of the antenna. In the following figures, elevation patterns are taken at azimuth equal to 0 and the azimuth cuts are taken at elevation equal to 0. Both polarizations have broad elevation patterns and the V-pol has broad azimuth patterns for most of the frequency range. The H-pol patterns due, in part, to the horizontal arms making the antenna look electrically longer in H-pol azimuth cut, it has a narrower azimuth beamwidth.

Looking at the antenna patterns in FIGS. 4A-5B, the patterns are flat over a +/−5 deg azimuth sweep, therefore it is believed that there will be no need to retune the antenna for installed performance. Since the elevation patterns are very broad, the antenna does not need to be installed directly on the center line of the platform. The combination of a 3:1 VSWR over frequency, 0 dBi gain at boresite for most of the band in both polarizations, and antenna patterns that have 3 dB beamwidth greater than 3 degrees in both azimuth and elevation were requirements so that the system using the antenna could meet its mission goals.

Figure 4A:
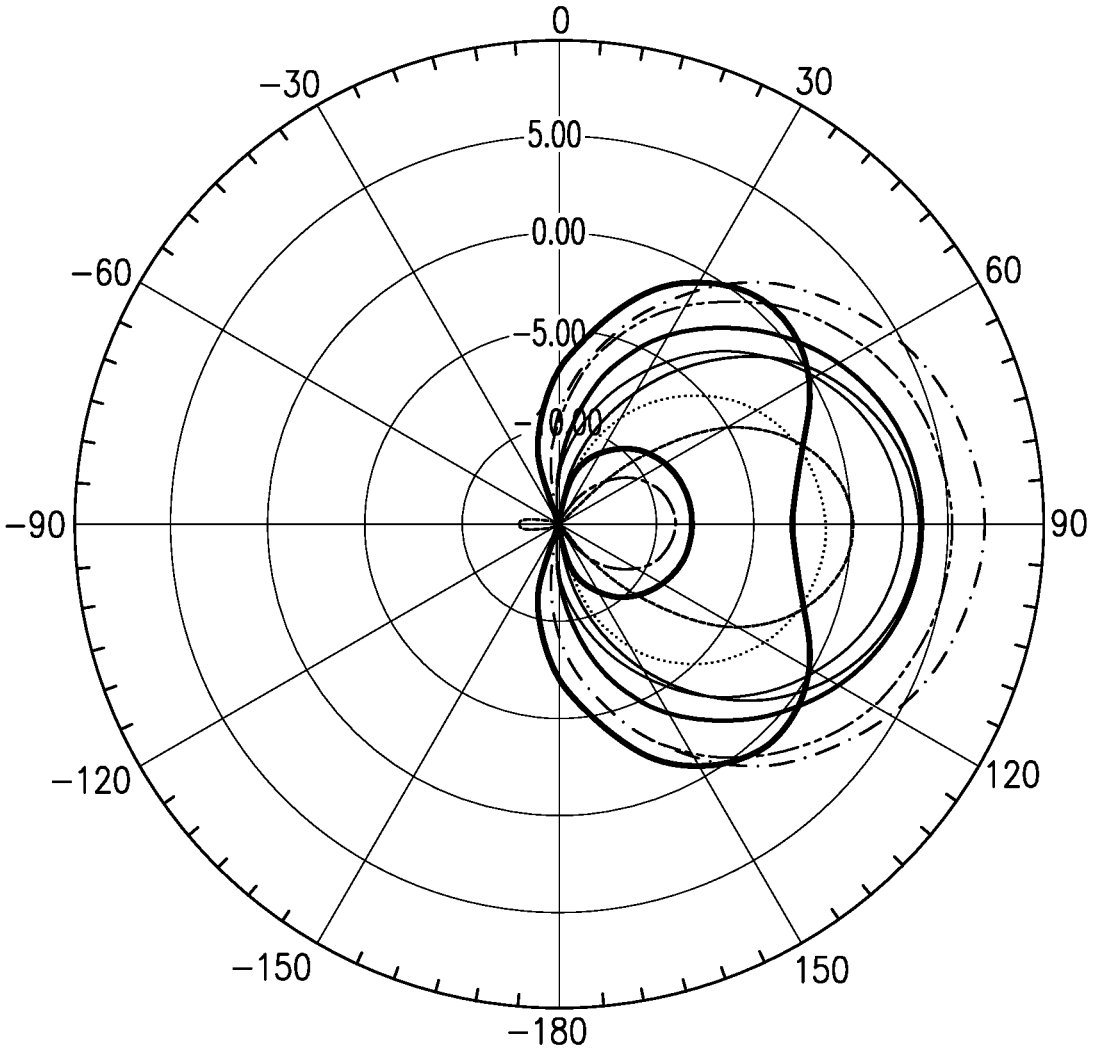
FIG. 4A shows a model boresite H-pol versus elevation pattern for one embodiment of a low profile high gain dual polarization UHF/VHF antenna of the present disclosure.

Referring to FIG. 4A, a model boresite H-pol elevation pattern for one embodiment of a low profile high gain dual polarization UHF/VHF antenna of the present disclosure is shown. These are representative patterns over a 5:1 bandwidth. It can been seen for most of the bandwidth the antenna patterns have ac beamwidth greater than 120 degrees.

Figure 4B:
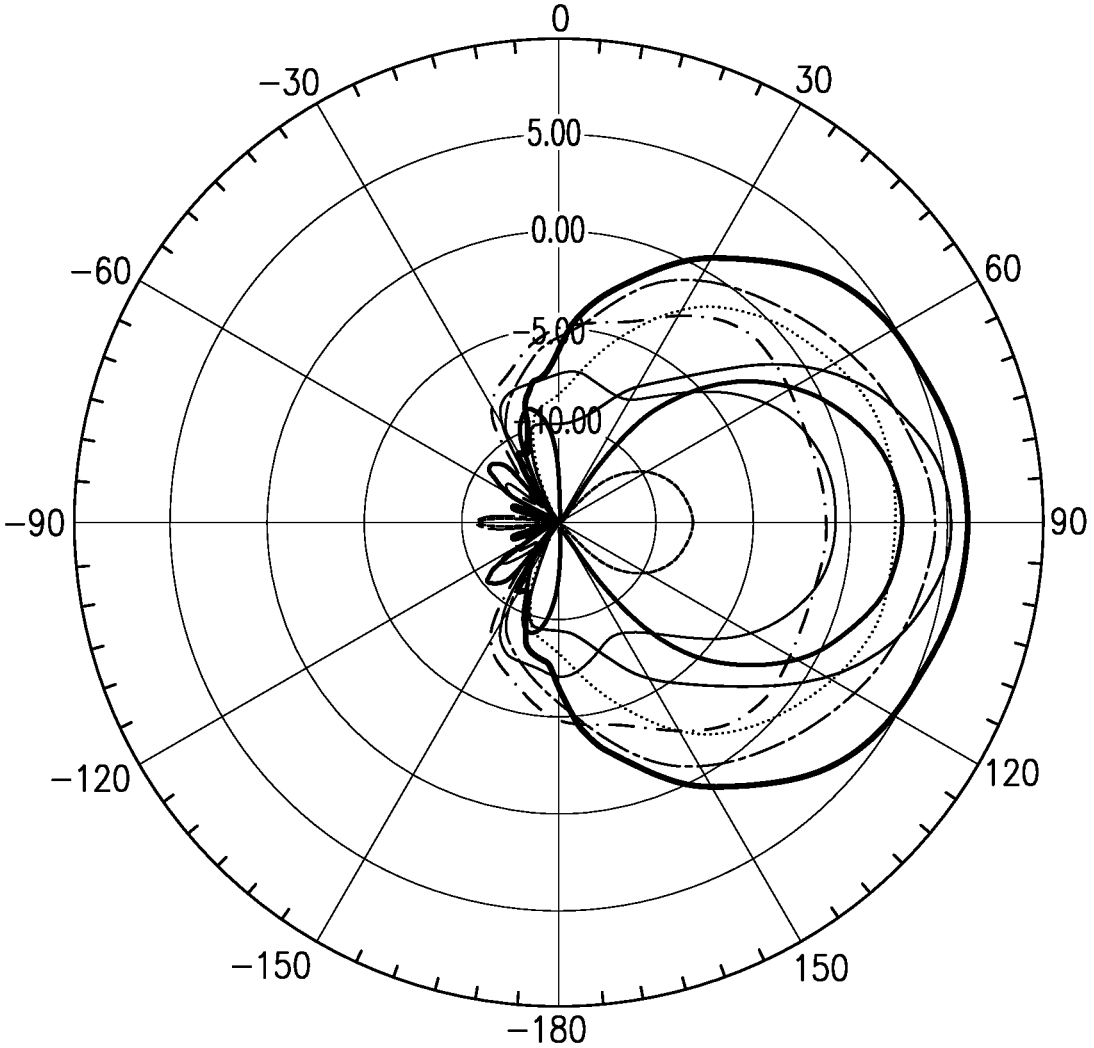
FIG. 4B shows a model boresite V-pol versus elevation pattern for one embodiment of a low profile high gain dual polarization UHF/VHF antenna of the present disclosure.

Referring to FIG. 4B, a model boresite V-pol elevation pattern for one embodiment of a low profile high gain dual polarization UHF/VHF antenna of the present disclosure is shown. More specifically, these are representative patterns over a 5:1 bandwidth. It can been seen for most of the bandwidth the antenna patterns have a 3 dB beamwidth greater than 60 degrees.

Figure 5A:
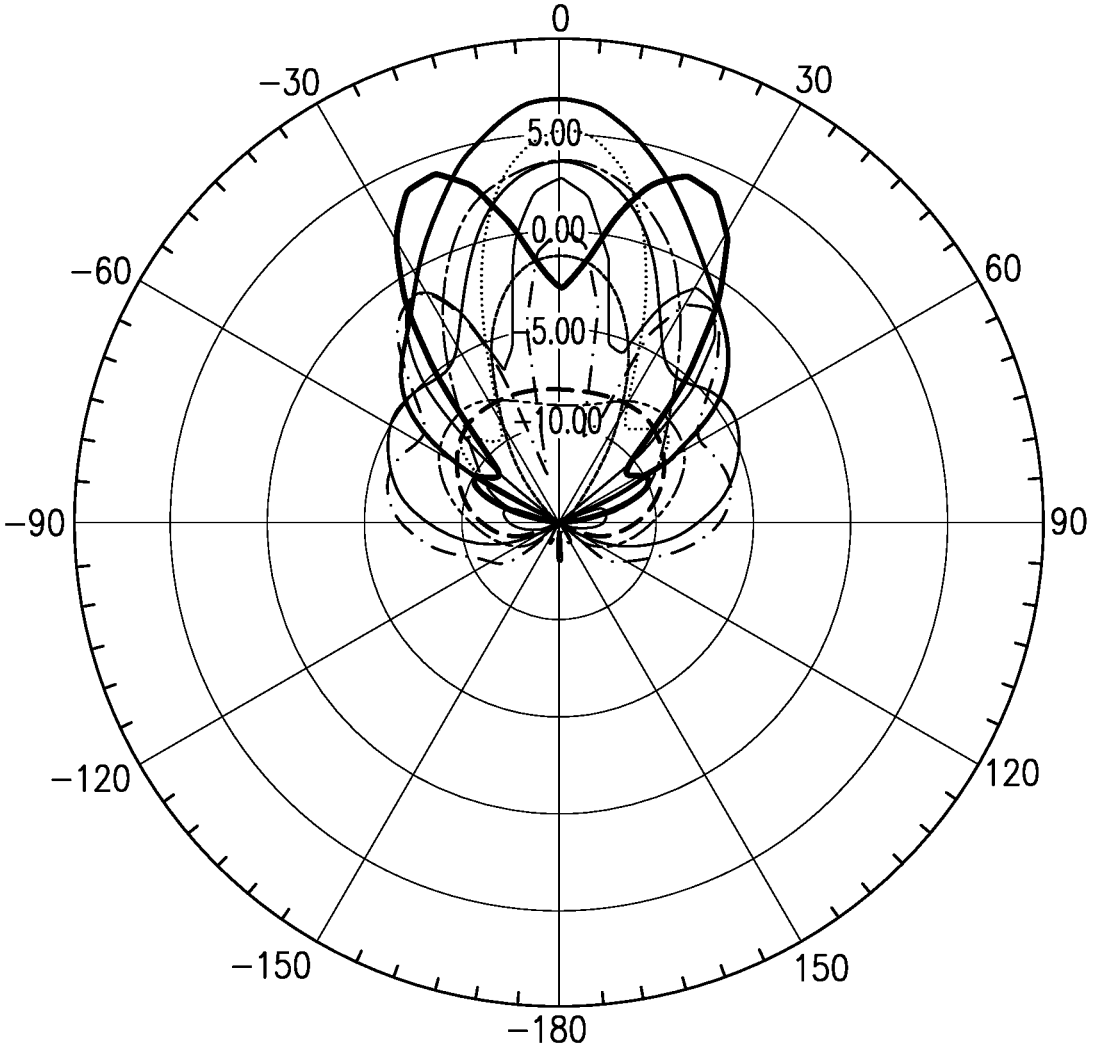
FIG. 5A shows a model boresite H-pol versus azimuth pattern for one embodiment of a low profile high gain dual polarization UHF/VHF antenna of the present disclosure.

Referring to FIG. 5A, a model boresite H-pol azimuth pattern for one embodiment of a low profile high gain dual polarization UHF/VHF antenna of the present disclosure is shown. More specifically, these are representative patterns over a 5:1 bandwidth. It can been seen for most of the bandwidth the antenna patterns have a 3 dB beamwidth greater than 10 degrees. Due to the fact that horizontal arms are required to get H-pol gain at the low end of the frequency bandwidth, the antenna looks electrically long at the high end of the frequency bandwidth, causing the H-pol gain to narrow in beamwidth at the high end.

Figure 5B:
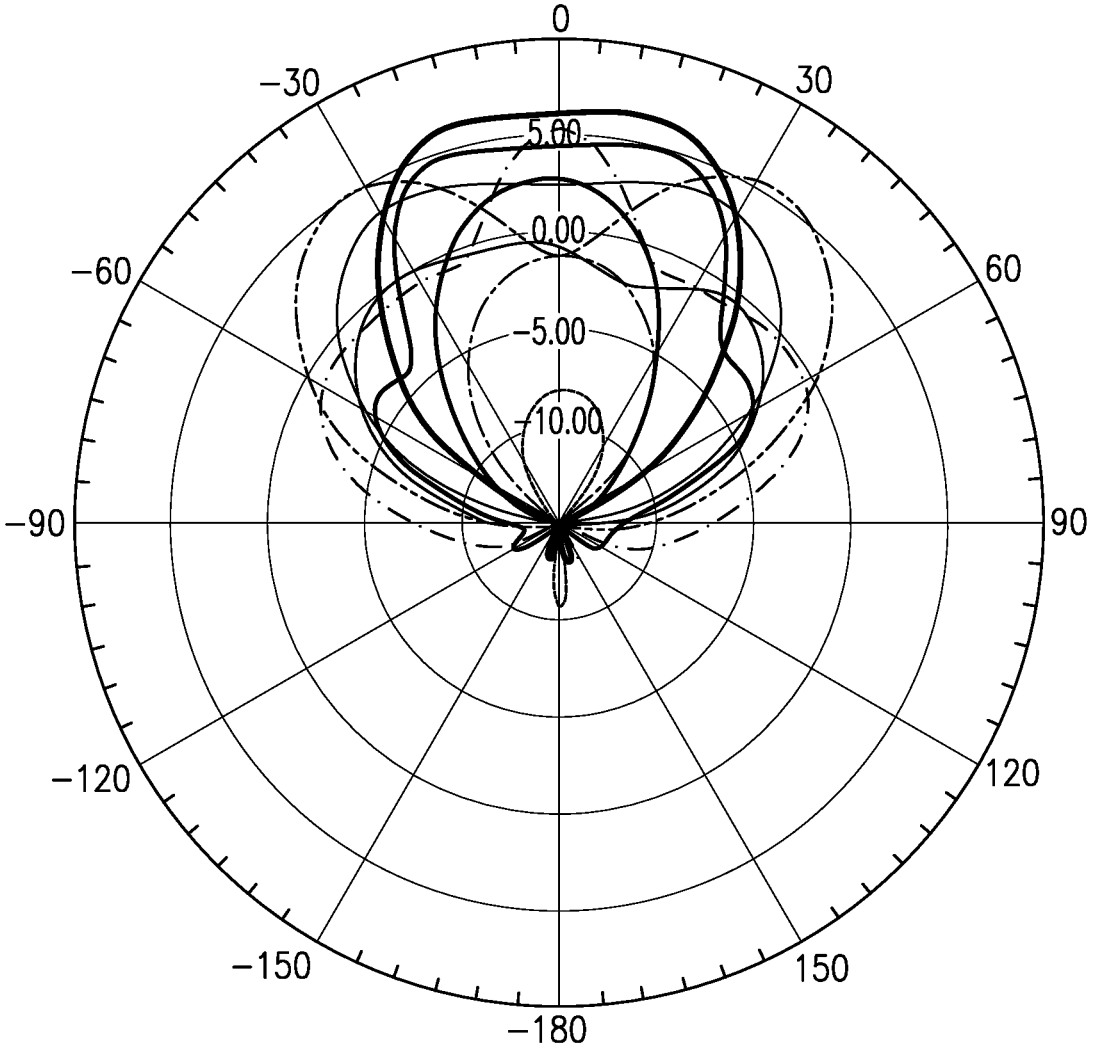
FIG. 5B shows a model boresite V-pol versus azimuth pattern for one embodiment of a low profile high gain dual polarization UHF/VHF antenna of the present disclosure.

Referring to FIG. 5B, a model boresite V-pol azimuth pattern for one embodiment of a low profile high gain dual polarization UHF/VHF antenna of the present disclosure is shown. More specifically, these are representative patterns over a 5:1 bandwidth. The beamwidth for the V-pol gain are wider than the H-pol because it is primarily only the spiral portion of the antenna that is radiating.

It is to be understood that the present invention can be implemented in various forms of hardware, software, firmware, special purpose processes, or a combination thereof In one embodiment, the present invention can be implemented in software as an application program tangible embodied on a computer readable program storage device. The application program can be uploaded to, and executed by, a machine comprising any suitable architecture.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A UHF/VHF antenna, comprising: a dual polarization spiral antenna located a distance above a ground plane, the spiral antenna having spiral sections with arms attached to the spiral sections; one or more resistors grounding the spiral sections and arms; a cavity being located under the spiral antenna and below the ground plane; at least one feed attached to the spiral antenna; wherein the distance above the ground plane is about two inches or less than /1;10 wavelength at a high frequency of operation;

wherein each of the arms comprise a plurality of rectangular sections;

and wherein the plurality of rectangular sections have resistors coupled in series electrically coupling the rectangular sections.

2. The UHF/VHF antenna according to claim 1, wherein the spiral antenna has a spiral with two or more spiral sections and corresponding two or more horizontal arms.

3. The UHF/VHF antenna according to claim 1, further comprising a dielectric substrate and wherein the spiral antenna is disposed on the dielectric substrate.

4. The UHF/VHF antenna according to claim 1, wherein the antenna has a 3:1 VSWR over a frequency bandwidth and 0 dBi gain at boresite for most of the band in both polarizations.

5. The UHF/VHF antenna according to claim 1, wherein the antenna is mounted to a side of an aircraft with a radar warning receiver system attached to it within the aircraft.

6. The UHF/VHF antenna according to claim 1, wherein the antenna is mounted to a side of an aircraft with a communications radio attached to it.

7. The UHF/VHF antenna according to claim 1, wherein the antenna is mounted to a side of an aircraft with a RF transmitter attached to it.

8. The UHF/VHF antenna of claim 1, wherein the high frequency of operation is in the UHF/VHF range.

* * * * *